US007922929B2

(12) United States Patent
Li et al.

(10) Patent No.: US 7,922,929 B2
(45) Date of Patent: Apr. 12, 2011

(54) CELLULOSIC FABRIC WITH SILK PEPTIDE/BUILDING BLOCK NANOPOLYMER

(75) Inventors: Yi Li, Kowloon (HK); Lok Yuen Lo, Kowloon (HK); Jun Yan Hu, Kowloon (HK)

(73) Assignee: The Hong Kong Polytechnic University, Hung Hom, Kowloon (HK)

( * ) Notice: Subject to any disclaimer, the term of this patent is extended or adjusted under 35 U.S.C. 154(b) by 436 days.

(21) Appl. No.: 11/655,931

(22) Filed: Jan. 22, 2007

(65) Prior Publication Data

US 2008/0175991 A1 Jul. 24, 2008

(51) Int. Cl.

| | |
|---|---|
| ***D06M 13/02*** | (2006.01) |
| ***D06M 13/00*** | (2006.01) |
| ***B05D 1/12*** | (2006.01) |
| ***C08L 89/00*** | (2006.01) |

(52) U.S. Cl. ..... 252/8.86; 8/128.1; 8/116.1; 8/115.51; 427/180; 525/54.1

(58) Field of Classification Search ..... 8/404, 128.1; 252/8.86; 427/180

See application file for complete search history.

(56) References Cited

U.S. PATENT DOCUMENTS

| | | | | |
|---|---|---|---|---|
| 2,565,832 | A * | 8/1951 | Whitner | 427/338 |
| 5,352,372 | A | 10/1994 | North | |
| 5,496,477 | A | 3/1996 | Tang et al. | |
| 5,705,475 | A | 1/1998 | Tang et al. | |
| 5,728,771 | A | 3/1998 | Tang et al. | |
| 6,517,933 | B1 * | 2/2003 | Soane et al. | 428/221 |
| 6,733,859 | B2 | 5/2004 | Yoneda et al. | |
| 6,997,960 | B1 | 2/2006 | Sano et al. | |
| 2005/0261425 | A1 * | 11/2005 | Rathore et al. | 525/54.1 |

OTHER PUBLICATIONS

Smeenk et al. "Peptide-Containing Block Copolymers: Synthesis and Potential Applications of Bio-Mimetic Materials", Current Organic Chemistry, 2005, 9, 1115-1125.*

* cited by examiner

*Primary Examiner* — Harold Y Pyon
*Assistant Examiner* — Katie Hammer

(57) ABSTRACT

The present invention relates a method of making a coated cellulosic textile, whereby a silk peptide is polymerized with a building block to develop a silk peptide/building block nanoparticle, said nanoparticle then being used to coat the textile. The resultant textile exhibits a high level of wrinkle recovery angle and/or tear strength, all without the use of N-methylol compounds, including ureas and formaldehydes.

20 Claims, 4 Drawing Sheets

Where Specimen 1 was the untreated control fabric
Specimen 2 was the cotton fabric imparted with silk peptide hybrid Where Specimen 3 was the cotton fabric imparted with soft segment formatted hybrid
Specimen 4 was the cotton fabric imparted with soft segment-peptide hybrid Where Specimen 6 was the cotton fabric imparted with the strong segment formatted hybrid
Specimen 5 was the cotton fabric imparted with the strong segment-protein hybrid

CELLULOSIC FABRIC WITH SILK PEPTIDE/BUILDING BLOCK NANOPOLYMER

BACKGROUND

Due to the high consumption demand and great competition between industries, modification on cotton material for imparting wrinkle-resistant properties has been incessantly conducted over the past decade. More than 200 related patents have been registered to the method, process or apparatus for wrinkle-resistant finishing. Mechanisms include crosslinking, acetylation, polymer deposition, polymer network entrapping, film sheathing, and some other physical methods. Due to the effectiveness, the most common technique applied in industry is crosslinking via formaldehyde, although the release of formaldehyde and strength loss are the associated drawbacks.

Corrective measurements are thus associated to reduce the amount or prevent the release of formaldehyde. U.S. Pat. Nos. 5,728,771, 5,705,475, 5,496,477, 5,352,372, 5,352,242, 5,310,418, 5,221,285, 4,975,209, 4,936,865, 4,900,324, 4,820,307, 4,773,911, 4,652,268, 4,623,356, 4,539,008, 4,488,878, 4,472,167, 4,472,165, 4,423,108, 4,336,023, 4,331,438, 4,295,846, 4,269,603, 4,269,602, and 4,127,382 are examples.

The application of natural proteinaceous material in the finishing system is revealed to minimize the hazard to the environment and the major application is modifying the fabric handle and the moisture absorbency of synthetic materials. CN1100172C, WO02059404, U.S. Pat. Nos. 5,718,954, and 6,997,960 are examples. The effect on wrinkle-resistant finishing system was reportedly limited. The combination application of DMDHEU, urethane, and silk powder reduced tearing strength loss by about 8% and the level of formaldehyde released was reduced to 3-fold lower than the standard requirement. However, formaldehyde agent is still the key component in the finishing system for achieving a high level of wrinkle recover angle.

It is an object of the present system to overcome the disadvantages and problems in the prior art.

DESCRIPTION

The present system proposes the fabrication of a silk peptide hybrid without the use of a N-methylol agent.

The present system also proposes the method of making textiles that possess high level of wrinkle recovery angle without the incorporation of an N-methylol agent, including ureas and formaldehydes.

The present system accomplishes the making of such textiles, in one manner, by utilizing a silk peptide and building block monomer.

The above statements are not intended as limitations apart from the application, but rather are to be inclusive of this application as a whole.

These and other features, aspects, and advantages of the apparatus and methods of the present invention will become better understood from the following description, appended claims, and accompanying drawings where:

Figure 3:
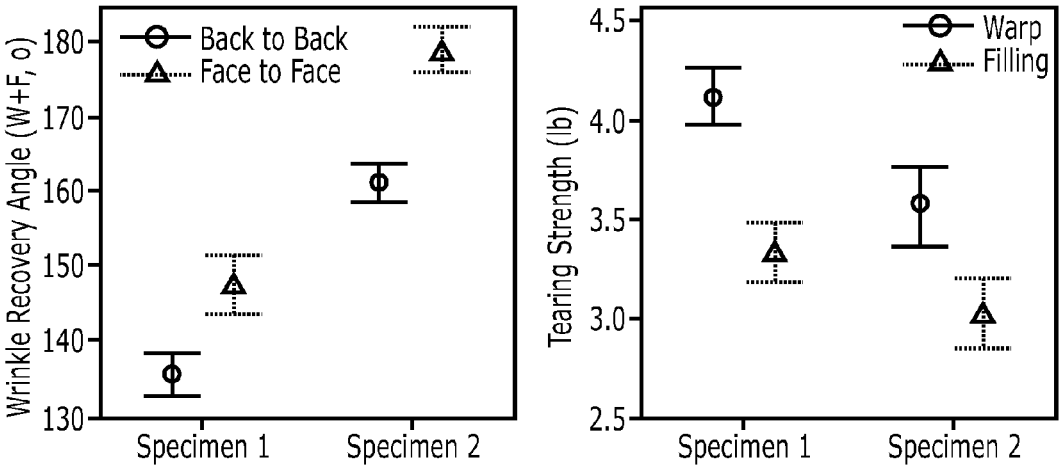
Figure 3:
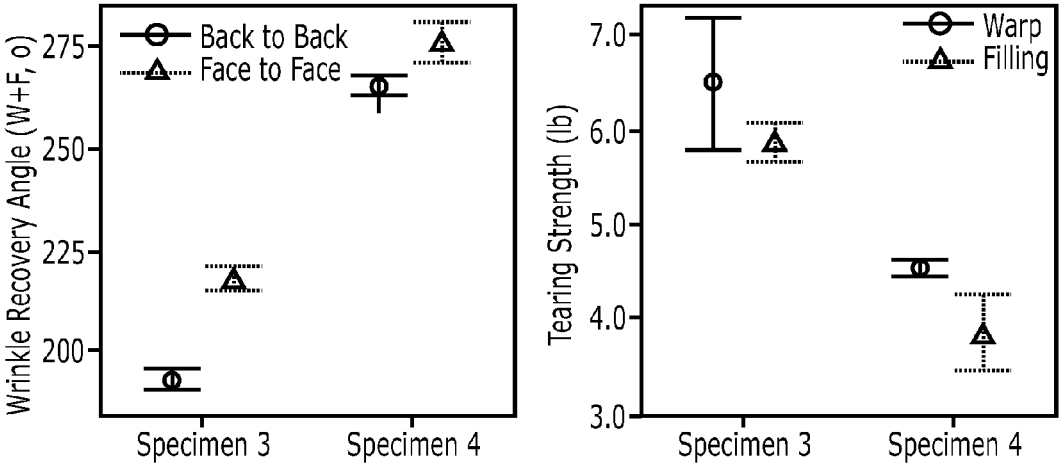

FIG. 3, pertaining to EXAMPLE 1, shows the effects of the present method on the wrinkle recovery angle when compared to prior methods.

Figure 4:
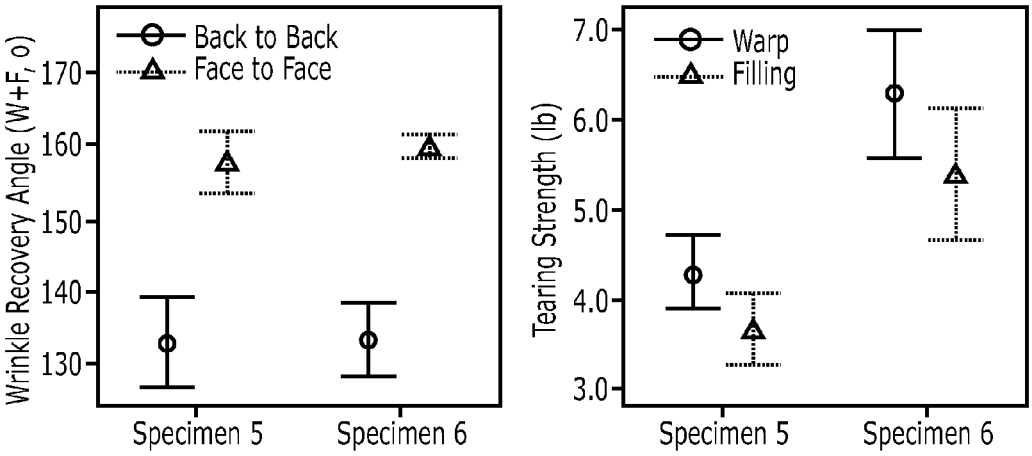

FIG. 4, pertaining to EXAMPLE 2, shows the effect of the present method on the tear strength of a textile when compared with the prior methods.

The following description of certain exemplary embodiment(s) is merely exemplary in nature and is in no way intended to limit the invention, its application, or uses. Throughout this description, the term "monomer" shall refer to an entity, compound, element, or unit capable of being comprised with or into another entity, compound, element, or unit to form a multi-unit structure (read: polymer).

The term "nanoparticle" refers to a particle in nano-size that exhibits different physical properties than the bulk material from which it is derived.

The term "about" as a modifier means to encompass future developments when such conditions are not critical beyond the teachings herein, and is not meant to encompass prior art where the present invention considers the conditions semi-critical or critical.

Figure 1:
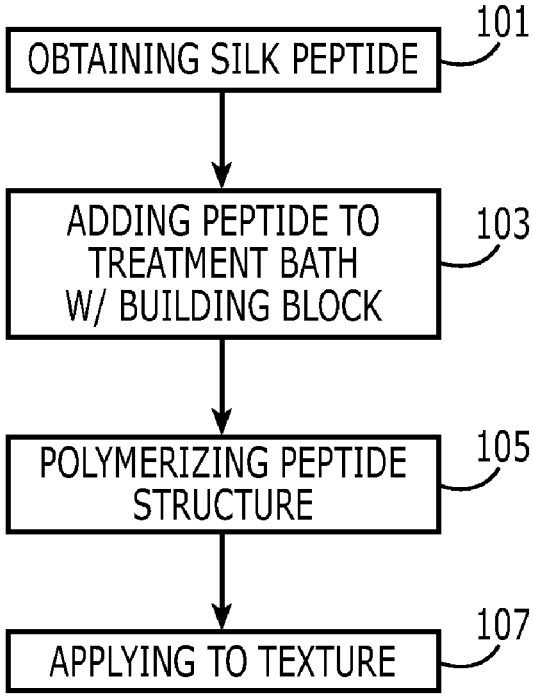
FIG. 1 shows a method of making a textile in accordance with the instant invention.

Now, specifically to FIGS. 1-4,

FIG. 1 shows a method of making a textile in accordance with the instant invention, comprising obtaining a silk peptide 101, adding such peptide to a treatment bath including a building block 103, polymerizing the peptide structure 105, and applying the peptide/building block emulsion to a substrate 107.

Silk peptide can be obtained 101 from different sources such as cocoons, raw silk, waste cocoons, raw silk waste, bisu, silk fabric waste, bourette, and silk fibroin. The silk peptide can include protein fibers, such as cocoon filaments, raw silk, silk fibers and knits, fibroin fiber, left over threads of the above or their ungummed material, half-degummed material, degummed material, fiber, powder, and film. Characteristics pertaining to the different sources of the silk peptide are known in the art.

In the event the silk peptide is obtained from silk fibroin, the fibroin may first be degummed. Degumming is performed to remove sericin from the fibroin. Sericin is a silk protein composed of 4 components with a molecular weight of 40,000. As is known in the art, an example of the degumming process involves boiling the silk peptide in an aqueous solution containing an alkaline sodium salt and soap. U.S. Pat. No. 7,115,388, incorporated herein by reference, teaches methods of degumming.

In preparing the silk fibroin, the fibroin can be dissolved in a solvent such as water, calcium nitrate, aqueous salt solutions containing alkali metal salts or alkaline earth metal salts, such alkali metal salts including LiCl, LiBr, NaI, $LiNO_3$, $MgCl_2$, $Mg(NO_3)_2$, $ZnCl_2$, $Zn(NO_3)_2$, LiSCN, NaSCN, $Ca(SCN)_2$, $Mg(SCN)_2$, $CaCl_2$, $Cu(NO_3)_2$, $Cu(NH_2CH_2CH_2NH_2)_2$, $CoH_2$, $Cu(NH_3)_4(OH)_2$, organic solvents as taught in U.S. Pat. No. 3,121,766, incorporated herein by reference, or combinations thereof in a molar ratio suitable for dissolving the silk fibroin.

Following dissolution, the resultant peptide can have a conformation of $\alpha$-helix, $\beta$-sheet, or random coiled structure. The peptide can be sized between about 50 to about 300 nm (nanoparticle size). In a preferred embodiment, the peptide is sized between 50 to 250 nm. In a more preferred embodiment, the peptide is sized between 60 to 100 nm. The particle size of the peptide is an important characteristic as the particle size plays an important role in the peptide/building block emulsion's coating of the substrate.

The peptide may then be added to a treatment bath, with such treatment bath comprising a building block polymer 103.

The treatment bath may be an aqueous solution, organic solvent, or a mixture aqueous/organic bath While a purely aqueous bath most effectively preserves the amorphous nature of silk peptide, a purely organic solvent bath transfers most silk peptide structure into crystalline entity.

The building block monomer is used for polymerizing with the peptide to form the peptide/building block emulsion. The building block can be a monomer that embarks soft segment properties, for example mid to high level elasticity, or a monomer that embarks hard segment properties, for example mid to high level of strengthening or stiffness. In an alternative embodiment, the building block may be comprised of both a soft segment and a hard segment, such that the resultant building block will possess soft properties less than a 100% pure soft segment, and hard properties less than a 100% pure hard segment.

Suitable soft segments include silicon-oxygen (Si—O) backbone polymers, such as bis(trimethylsilyl)amine $[(CH_3)_3\ Si—NH—Si(CH_3)_3)]$, phenylsiloxane having the general formula $(SiO(C_6H_5)_2O_n$, silicones/polysilicones having the general formula $R_2SiO_n$, where R=methyl, ethyl, or phenyl groups, poly n-methyl siloxane having the general formula $[(H_3C)ISiO(CH_3)_2]_2Si(CH_3)]_n$, polymethylhydrosiloxane RnSiXmOy, where R=methyl or phenyl, in which case when R=methyl, R can be selected from the group consisting of $(CH_3)_3SiO$, $(CH_3)_2SiO_2$, $CH_3SiO_3$, and $SiO_4$, vinylsilane, aminosilane, and epoxysilane.

The soft segment can also be selected from amino amide derivatives, such as those of the general formula $R^1$—$NR^2$—$COR^3$, wherein $R^1$, $R^2$, and $R^3$ can be independently selected from the group consisting of hydrogen, alkyl, allyl, alkenyl, aryl, heteroaryl, acyl, sulfonyl, amino, alkylamino, dialkylamino, acylamino, sulfonylamino, and alkyoxy. Further $R^1$ and $R^2$ can also be connected together to form a ring. $R^1$, $R^2$, and $R^3$ can also be connected to a polymeric chain or other solid phase material.

The soft segment can further be drawn from groups including imidazoline, alkyl aryl sulphonate, and thermoplastics such as polyurethanes, polyvinylacetate, polyethylene, polypropylene, polyester, and polyamide. Specific examples of soft segments include ethylene oxide, aminoethylamine propylsiloxone, and dimethyl siloxone.

When the soft segment is polymerized with the peptide, the ratio of peptide to soft segment can be from 1:99 to 99:1. In a preferred embodiment, the ratio is from about 4:1 to about 10:1.

The soft segment may be used in a particle size of from 50 to 500 nm.

Hard segments can be used as the building block in the present method. Hard segments polymerized with the peptide strengthen substrates coated with the peptide/hard segment emulsion.

Suitable hard segments include polyethers such as polyoxymethylene, poly(ethylene oxide), poly(propylene oxide), poly(styrene oxide), polyhexamethylene adipamide, poly (ethylene trephthalate), and crystalline entities thereof, including crystalline protein. The polyethers may be aliphatic or aromatic, generally of the formulas $(CH_2)_nO$ or $[ArOR]_n$.

The ratio of peptide to hard segment can be in the range of from 1:99 to 99:1. In a preferred embodiment, the ratio may be in the range of from about 1:1 to about 10:1. The hard segment can be used in a particle size of between 50 to 500 nm.

In yet another embodiment, the peptide can be combined with both a hard and a soft segment. In such manner, a substrate coated with the peptide/hard segment/soft segment emulsion would exhibit the desired characteristics of the soft segment and the hard segment while decreasing the undesirable characteristics of both segment species. Both the soft segment and hard segment can have particle sizes ranging from 50 to 300 nm. Ratio of peptide:soft segment:hard segment can be from 1:1:5 to 10:1:1.

Polymerizing the peptide with the building block 105 in the treatment bath can occur by, for example, emulsion polymerization. Polymerization may be initiated by initiators such as metal chlorides or metal nitrates. Suitable metal compounds include $MgCl_2$, $LiCl_2$, NaCl, $Mg(NO_3)_2$, $Li(NO_3)_2$, $Na(NO_3)$, and the like. Alkyl and aryl derivatives of the metal compounds are also suitable initiators. It is known in the art that the selection of the initiator is key for initiating the reaction between the selected monomers. The initiator can be used in an amount of from 0 to about 3% concentration. Polymerization should occur at an elevated temperature, between approximately 110° C. to 180° C. The total time period for polymerization can be between approximately 2 to about 30 minutes.

Additionally, nonionic dispersing or wetting agents may be added to the emulsion for improved distribution of the peptide/building block polymer in the emulsion and the uniformity of the polymer following application to the substrate. The emulsion can comprise from 0 to about 1% of the above agents.

The emulsion may then be stored for future use, such as using polyethylene films for storage. In an industrial setting, storage is particularly important as a batch of the emulsion will likely be produced and stored for application to various substrates at different intervals.

Following polymerization 105, the resultant peptide/building block emulsion is applied to a substrate. Application may occur immediately or may occur following storage of the emulsion.

Suitable substrates for accepting the peptide/building block emulsion include cellulosic fabric, such cellulosic fabric being made out of natural materials including cotton, wool, angora, flax, silk, jute, modal, velvet, fur, and leather. In one embodiment, the cellulosic fabric can be made out of blends of natural materials and synthetic materials, such synthetic materials including polyester, acrylic, and nylon.

The emulsion may be applied to the substrate via conventional methods, allowing for a physiochemical adherence to the substrate. Suitable methods of application include immersion, such as vat immersion, padding, spraying such as air-atomized spraying, air-assisted spraying, airless spraying, and high volume low pressure spraying, coating such as direct coating including the use of doctor's blades, roll coating, or rotary screen coating. Other methods of application include extrusion coating, melt calendar coating, cast coating, foam coating, spray coating, curtain coating, and rod coating. In one embodiment, application is performed by either immersion, padding, or spraying.

Application to the substrate 107 is usually followed by drying, for example by Mitchell drying or forced air-drying. Alternatively, squeezing of the substrate may be performed through the use of pairs of rolls.

Following drying, the substrate can be cured through conventional means. Curing may be performed at a temperature of about 130° C. to about 170° C. for a period of 1 to 3 minutes.

In the treatment bath, the liquor ratio should be around 10:1 to around 20:1. The wet pick up can be from about 70% to about 90%.

Because of the nanoparticle size of the peptide/building block polymer, the polymer is able to become affiliated into the substrate via the pores possessed by the substrate. Incorporation within the pores allows the importation of properties to the substrate, without the use of harmful finishing agents, for example N-methyol agents, including ureas and formaldehydes. Specifically, by incorporating a peptide/building block polymer, the feel and touch of the substrate is improved, while at the same time improving properties such as elasticity or strength. In this way, final products, for example shirts or slacks, can be produced that have a soft feel but are wrinkle resistant, while at the same time not exposing the wearer to harmful agents such as formaldehyde.

Through the present method, when industrially applying the peptide/building block polymer, additional plant equipment is not necessary in preparing substrates according to the present invention. Scale up may be required, however such means of scaling up are well-known within the art and fall within the teachings of the instant invention.

Figure 2:
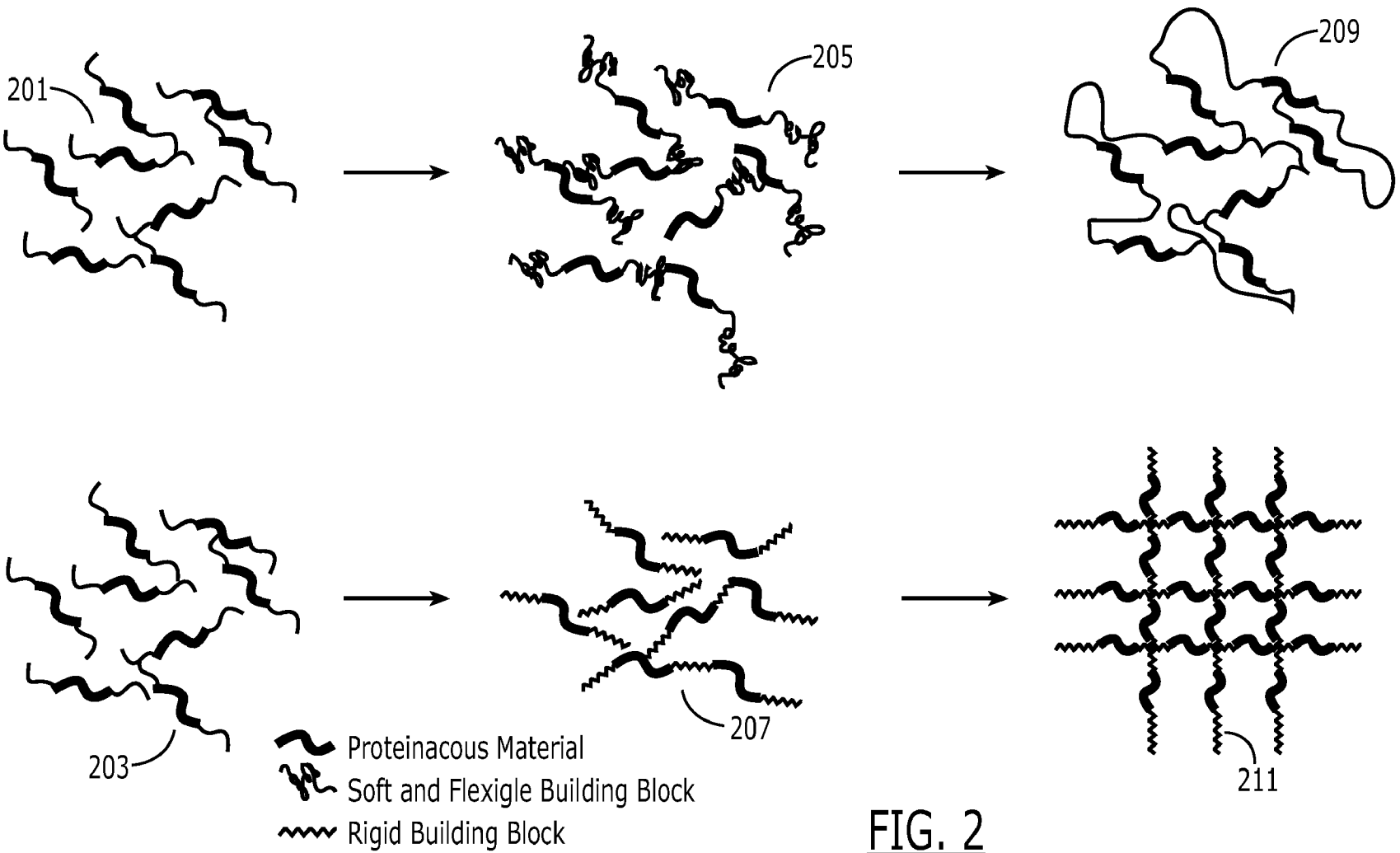
FIG. 2 shows the polymerization of a silk peptide in accordance with the present method.

FIG. 2 shows the polymerization of a silk peptide 201/203 by a soft segment 205 or a hard segment 207, resulting in respective peptide/soft segment polymers 209 or peptide/hard segment polymers 211. As shown, in the intermediate steps of polymerization 205/207, the segments are grafted unto the peptide linkages following initiation. The resultant polymers 209/211 are representative of the building blocks used, i.e., the use of a soft segment results in a more amorphous conformation 209, whereas the use of a hard segment results in a more structured conformation 211. Alternatively, as mentioned previously, a soft segment/hard segment monomer can be used in the polymerization of the peptide. A resultant polymer would thus have a conformation that would fall somewhere between amorphous and structured. The resultant polymers are present in nanoparticle size, from 50 to 300 nm.

FIGS. 3 and 4 pertain to the following examples,

EXAMPLE 1

FIG. 3 shows the comparison of the wrinkle recovery angle and tearing strength for an untreated cotton substrate, a cotton substrate treated with a silk peptide, a cotton substrate treated with a soft segment, and a cotton substrate treated with a peptide/soft segment emulsion made in accordance with the present invention.

Specimen 2 was prepared using the following components and amounts:

| Component | Amount (wt %) |
|---|---|
| NS001 ™ | 5 |
| $MgCl_2$ | 1.5 |
| Acetic Acid | 0.01 |
| Non-ionic Detergent | 0.01 |

Specimen 3 was prepared by treating the cotton substrate with a soft segment composed of Si—O and was provided by NanoSport™ with the commercial name SSOO1™.

Specimen 4 was prepared according to the following formula:

| Component | Amount (wt %) |
|---|---|
| NS001 ™ | 10 |
| SSOO1 ™ | 2 |
| MgCl2 | 1.5 |
| Acetic Acid | 0.01 |
| Non-ionic Detergent | 0.01 |

Specimens 2, 3, and 4 were prepared using a water-based silk peptide solution with a mean particle size of 70 nm. All other components used were of reagent grade. A cotton twill fabric was padded to 80% wet pick up by adjusting the padding pressure at 2 kg/cm$^2$ and a roller speed of 4 rpm. After drying at 80° C. for 3 minutes, the fabric was cured at 160° C. for 3 minutes. Floating reactants on the surface of the fabric were rinsed off using detergent followed by hot and cold water rinsing for 3 minutes. After drying at 80° C. for 3 minutes, fabric was conditioned under standard conditions (65±2% RH and 21±1° C.) for 24 hours prior to the evaluation of physical properties. Wrinkle recovery angle and tearing strength of the samples were determined according to the standard testing methods AATCC 66 and ASTMD 1424.

As shown in FIG. 3, in comparison with the untreated cotton substrate, Specimen 2 showed a wrinkle recovery angle increase of 20% after the impartment of the silk peptide. Comparing the wrinkle recover angle of Specimen 4 vs. Specimen 3, Specimen 4 showed a wrinkle recovery angle of 32% higher than Specimen 3, with 270 (W+F, o) attained. At this level of wrinkle recovery angle, although the tearing strength of Specimen 4 decreased relative to Specimen 3, no tearing strength of Specimen 4 suffered when compared to the untreated control fabric (Specimen 1).

EXAMPLE 2

In another embodiment for reinforcing a textile fabric, a peptide was polymerized with the polyether hard segment CO-PP-002™ provided by Nanosport™. The ratio of peptide to hard segment was 2:1, with the formula being:

| Component | Amount (wt %) |
|---|---|
| NS001 ™ | 14 |
| CO-PP-002 ™ | 7 |
| $Zn(BF_4)_2$ | 0.5 |
| Acetic Acid | 0.07 |
| Non-ionic Detergent | 0.01 |

The application method and treatment conditions were the same as in Example 1.

As shown by FIG. 4, the tearing strength of Specimen 6, the specimen treated with the peptide/hard segment polymer was 47% higher when compared with Specimen 5, the specimen treated with only the hard segment monomer.

Having described embodiments of the present system with reference to the accompanying drawings, it is to be understood that the present system is not limited to the precise embodiments, and that various changes and modifications may be effected therein by one having ordinary skill in the art without departing from the scope or spirit as defined in the appended claims.

In interpreting the appended claims, it should be understood that:

a) the word "comprising" does not exclude the presence of other elements or acts than those listed in the given claim;

b) the word "a" or "an" preceding an element does not exclude the presence of a plurality of such elements;

c) any reference signs in the claims do not limit their scope;

d) any of the disclosed devices or portions thereof may be combined together or separated into further portions unless specifically stated otherwise; and e) no specific sequence of acts or steps is intended to be required unless specifically indicated.

d) any of the disclosed devices or portions thereof may be combined together or separated into further portions unless specifically stated otherwise; and e) no specific sequence of acts or steps is intended to be required unless specifically indicated.

The invention claimed is:

1. A method of making a coated substrate, comprising the steps:

preparing a silk peptide with a particle size of from 50 to 250 nm by degumming silk fiber, and dissolving the silk fiber in an organic solvent;

adding said peptide to a treated bath containing a building block polymer having a particle size of from 50 to 500 nm;

polymerizing said peptide with said building block; and applying the peptide/building block polymer to a cellulosic substrate, wherein the building block is a soft segment that is selected from the group consisting of silicon-oxygen backbone polymers, amino amide derivatives, imidazoline, alkyl aryl sulphonate, thermoplastics, ethylene oxide, aminoethylamine propylsiloxone, and dimethyl siloxone, and wherein the ratio of said peptide to said soft segment is from about 4:1 to about 10:1.

2. The method of claim 1, further comprising the step of drying said peptide/building block polymer-coated substrate.

3. The method of claim 1, further comprising the step of curing said peptide/building block polymer-coated substrate.

4. The method of claim 1, wherein said peptide is derived from the group consisting of silk fibroin, cocoon, raw silk, waste cocoon, raw silk waste, bisu, silk fabric waste, and bourette.

5. The method of claim 1, wherein said treatment bath can be an aqueous solution, organic solvent, or an aqueous/organic solvent mixture.

6. The method of claim 1, wherein polymerization of said peptide with said building block is brought about by an initiator selected from the group comprising metal chlorides or metal nitrates.

7. The method of claim 1, wherein polymerizing occurs between a temperature of 110° C. to 180° C. for a period of 2 minutes to about 30 minutes.

8. The method of claim 1, further comprising the step of adding a dispersing or wetting agent prior to applying said polymer to said substrate.

9. The method of claim 1, wherein applying said polymer may occur by means selected from the group consisting of immersion, padding, spraying, coating, and calendaring.

10. The method of claim 1, wherein said substrate is selected from the group comprising cotton, wool, angora, flax, silk, jute, modal, velvet, fur, leather, and natural material/synthetic material blends.

11. A polymer-coated substrate, comprised of a cellulosic fabric and silk peptide/soft segment polymer, wherein said soft segment is selected from the group consisting of silicon-oxygen backbone polymers, amino amide derivatives, imidazoline, alkyl aryl sulphonate, and thermoplastics, wherein said polymer-coated substrate possesses a wrinkle recovery angle between 250-290 (W+F,o), and wherein said polymer-coated substrate does not comprise N-methylol compounds.

12. A polymer-coated substrate, comprised of a cellulosic fabric and silk peptide/hard segment polymer, wherein said hard segment is selected from the group consisting of polyethers and crystalline entities, wherein said polymer-coated substrate possesses a tear strength of from 4.7 to 7lbs, and wherein said polymer-coated substrate does not comprise N-methylol compounds.

13. A method of making a coated substrate, comprising the steps:

preparing a silk peptide with a particle size of from 50 to 250 nm by degumming silk fiber, and dissolving the silk fiber in an organic solvent;

adding said peptide to a treated bath containing a building block polymer having a particle size of from 50 to 500 nm;

polymerizing said peptide with said building block; and applying the peptide/building block polymer to a cellulosic substrate, wherein said building block is a hard segment that can be selected from the group consisting of polyethers and crystalline entities, and wherein the ratio of said peptide to said hard segment is from about 1:1 to about 10:1.

14. The method of claim 13, further comprising the step of drying said peptide/building block polymer-coated substrate.

15. The method of claim 13, further comprising the step of curing said peptide/building block polymer-coated substrate.

16. The method of claim 13, wherein said peptide is derived from the group consisting of silk fibroin, cocoon, raw silk, waste cocoon, raw silk waste, bisu, silk fabric waste, and bourette.

17. The method of claim 13, wherein said treatment bath is an aqueous solution, organic solvent, or an aqueous/organic solvent mixture.

18. The method of claim 13, wherein said polyethers can be selected from the group consisting of polyoxymethylene, poly(ethylene oxide), poly(propylene oxide), poly (styrene oxide), polyhexamethylene adipamide, and poly (ethylene trephthalate).

19. The method of claim 13, wherein polymerization of said peptide with said building block is brought about by an initiator selected from the group comprising metal chlorides or metal nitrates.

20. The method of claim 13, wherein said substrate is selected from the group comprising cotton, wool, angora, flax, silk, jute, modal, velvet, fur, leather, and natural material/synthetic material blends.

* * * * *